US007775191B2

(12) United States Patent
Hou

(10) Patent No.: US 7,775,191 B2
(45) Date of Patent: Aug. 17, 2010

(54) CONSTANT-SPEED MULTI-PRESSURE FUEL INJECTION SYSTEM FOR IMPROVED DYNAMIC RANGE IN INTERNAL COMBUSTION ENGINE

(75) Inventor: Shou L Hou, Radnor, PA (US)

(73) Assignee: TMC Company, Wayne, PA (US)

( * ) Notice: Subject to any disclaimer, the term of this patent is extended or adjusted under 35 U.S.C. 154(b) by 0 days.

(21) Appl. No.: 12/014,013

(22) Filed: Jan. 14, 2008

(65) Prior Publication Data

US 2008/0173280 A1 Jul. 24, 2008

Related U.S. Application Data

(63) Continuation of application No. 10/143,657, filed on May 10, 2002, now Pat. No. 7,318,414.

(51) Int. Cl.
*F02M 37/00* (2006.01)
*F02M 59/36* (2006.01)

(52) U.S. Cl. ..... 123/458; 123/511; 123/514

(58) Field of Classification Search ..... 123/510, 123/511, 514, 457, 458, 497
See application file for complete search history.

(56) References Cited

U.S. PATENT DOCUMENTS 3,827,409 A 8/1974 O'Neill
4,274,380 A 6/1981 de Vulpillieres
4,353,385 A 10/1982 Maisch et al.
4,719,889 A 1/1988 Amann et al.
5,035,223 A 7/1991 Watanabe
5,085,193 A 2/1992 Morikawa
5,207,203 A 5/1993 Wagner et al.
5,284,119 A 2/1994 Smitley
5,313,924 A 5/1994 Regueiro
5,327,872 A 7/1994 Morikawa
5,351,666 A 10/1994 Bronkal et al.
5,355,859 A 10/1994 Weber
5,367,999 A 11/1994 King et al.
5,373,829 A 12/1994 Schuers et al.
5,425,342 A 6/1995 Ariga et al.
5,456,233 A 10/1995 Felhofer
5,513,613 A 5/1996 Taylor et al.
5,558,063 A 9/1996 Minagawa et al.
5,572,964 A 11/1996 Cogneville et al.
5,598,817 A 2/1997 Igarashi et al.
5,642,716 A 7/1997 Ricco
5,720,263 A 2/1998 Frank et al.
5,727,515 A 3/1998 Biester
5,727,525 A 3/1998 Tsuzuki
5,758,622 A 6/1998 Rembold et al.

(Continued)

*Primary Examiner*—Thomas N Moulis
(74) *Attorney, Agent, or Firm*—Buchanan Ingersoll & Rooney PC

(57) ABSTRACT

A fuel injection system operates under a predetermined substantially constant pump speed and creates multi-pressure levels by diverting the fuel flow. Fuel pressure can be switched from one steady pressure level to another level on-demand instantly. This superimposes and overlaps typical fuel injection events in the linear operating ranges under different pressure levels, significantly increasing the fuel injection dynamic range. The dynamic range is further increased when another predetermined constant pump speed is assigned. Thus, the system saves fuel and reduces exhaust emission in city driving when gas pedal is released including idle. The same system can instantly deliver additional fuel on-demand for extra power beyond engine rating producing a sport-car-like performance.

22 Claims, 6 Drawing Sheets

U.S. PATENT DOCUMENTS

| | | | | |
|---|---|---|---|---|
| 5,762,046 | A | 6/1998 | Holmes et al. | |
| 5,784,586 | A | 7/1998 | Simone et al. | |
| 5,794,586 | A | 8/1998 | Oda et al. | |
| 5,918,578 | A | 7/1999 | Oda | |
| 5,927,253 | A | 7/1999 | Oyafuso et al. | |
| 5,967,119 | A | 10/1999 | Burkhard et al. | |
| 6,021,763 | A | 2/2000 | Yoshihara et al. | |
| 6,024,064 | A | 2/2000 | Kato et al. | |
| 6,032,642 | A | 3/2000 | Trumbower et al. | |
| 6,119,655 | A | 9/2000 | Heinitz et al. | |
| 6,125,823 | A | 10/2000 | Thomas | |
| 6,142,120 | A | 11/2000 | Biester et al. | |
| 6,155,234 | A | 12/2000 | Hartke et al. | |
| 6,170,473 | B1 | 1/2001 | Pontoppidan | |
| 6,223,725 | B1 | 5/2001 | Onishi et al. | |
| 6,234,151 | B1 | 5/2001 | Eck | |
| 6,253,735 | B1 | 7/2001 | Miyajima | |
| 6,276,340 | B1 | 8/2001 | Kato | |
| 6,394,072 | B1 | 5/2002 | Yoshida et al. | |
| 6,408,822 | B1 | 6/2002 | Rembold et al. | |
| 6,474,310 | B2 | 11/2002 | Joos | |
| 6,712,044 | B1 | 3/2004 | Rembold et al. | |
| 6,718,948 | B2 | 4/2004 | Vahle et al. | |
| 6,953,025 | B2 * | 10/2005 | Takahashi | 123/497 |
| 7,025,050 | B2 * | 4/2006 | Oono et al. | 123/690 |
| 7,066,149 | B1 * | 6/2006 | Date et al. | 123/457 |

* cited by examiner

Data From An Injector Manufacturer

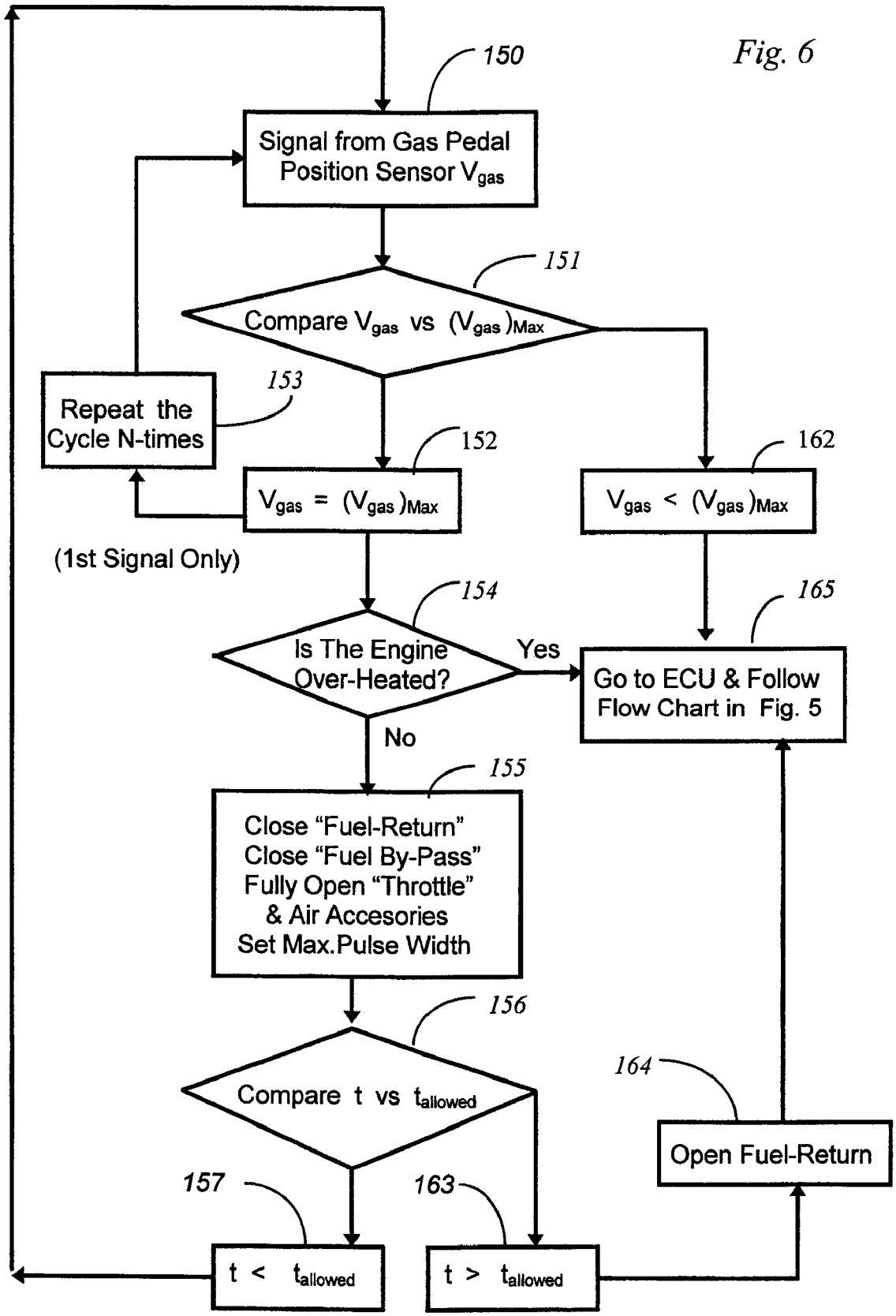
Fig. 6
150
Signal from Gas Pedal Position Sensor $V_{gas}$
151
Compare $V_{gas}$ vs $(V_{gas})_{Max}$
153
Repeat the Cycle N-times
152
$V_{gas} = (V_{gas})_{Max}$
(1st Signal Only)
162
$V_{gas} < (V_{gas})_{Max}$
154
Is The Engine Over-Heated?
Yes
No
165
Go to ECU & Follow Flow Chart in Fig. 5
155
Close "Fuel-Return"
Close "Fuel By-Pass"
Fully Open "Throttle"
& Air Accesories
Set Max.Pulse Width
156
Compare t vs $t_{allowed}$
164
Open Fuel-Return
157
163
$t < t_{allowed}$
$t > t_{allowed}$

CONSTANT-SPEED MULTI-PRESSURE FUEL INJECTION SYSTEM FOR IMPROVED DYNAMIC RANGE IN INTERNAL COMBUSTION ENGINE

PRIORITY CLAIM

This application is a continuation U.S. patent application Ser. No. 10/143,657, filed on May 10, 2002 now U.S. Pat. No. 7,318,414, which is hereby incorporated by reference.

FIELD OF THE INVENTION

This invention relates to engines, specifically a fuel system used for engines making use of a fuel injection system.

BACKGROUND OF THE INVENTION

Engine emission, such as auto emission, is one of the most contributing factors to air pollution. It is most noticeable in metropolitan areas during traffic jams, and around airports where numerous airplanes are idling in the secondary runway for 20 to 40 minutes on the average before taking off. Reducing the idle speed in internal combustion engines will save fuel when an engine is not doing much work other than keeping it alive. It also reduces exhaust emission, which converts to smog. The problem is most serious in metropolitan areas because there are more than 230 million units of light vehicles in the U.S. as of 2005, most of which are concentrated in the metropolitan areas. Another 16 million plus units of new vehicles is added to its population every year. Perhaps a more meaningful way of reducing pollution and improving energy is by measuring how much fuel is consumed per mile traveled by any vehicle at any speed. This measurement indicates the amount of fuel consumed and exhaust generated in the distance traveled. It becomes apparent that a better control of fuel consumption at slow speed (or idle) will have more impact on pollution control, fuel saving, and improvement on the city driving mileage.

Improving control of fuel consumption at low speeds must not adversely affect performance of the engine. For example, it is commonly known in physics that the kinetic energy of a moving vehicle is directly proportional to its mass (or weight). More energy is required to maintain a heavier vehicle at any speed than a lighter vehicle at the same speed. On the other hand, the amount of energy delivered by a gallon of gasoline is constant. As a result, more fuel is needed to move a heavier vehicle than a lighter one in highway driving. More fuel is also needed to accelerate a vehicle quickly. In view of these considerations, it is desirable to meet the energy demands of the engine over the full range of load conditions while also lowering fuel consumption, especially when the gas pedal is released including idle. The reduced fuel consumption will improve fuel efficiency, particularly for city driving.

Engine pistons deliver torque T to the flywheel. This is balanced by frictions of the engine and the drag by accessories like the cooling flywheel fan and generator when idle. To the first order of approximation, the balancing torque is proportional to the speed of rotation ω. The power required to keep the flywheel idling at a speed of rotation ω is Tω. It is supplied by fuel injected per second Q. The kinetic energy of the flying wheel is transmitted to the moving vehicle through mechanical means.

Since Energy delivered to the engine per second~Q~Tω
Power produced by the engine and $Q \sim \omega q$ $$\text{hence, } q \sim T \sim I\alpha \sim M\omega \tag{1}$$

$$\text{and } Q \sim q^2 \tag{2}$$

where ω is the engine speed in rps (or in rpm/60),
M is the effective mass of the engine flying wheel,
T is the torque, "α" is the angular acceleration,
I is the angular moment of inertia of the flying wheel,
Q is the total amount of fuel injected per second, and
q is the amount of fuel injected per pulse.

In other words, to the first order of approximation, the engine idling speed ω is directly proportional to the amount of fuel injected per pulse q, and the total amount of fuel consumption rate Q is proportional to the square of the amount of fuel injected per pulse q. A 10% reduction to the fuel injected per pulse will save about 19% of total fuel consumption per second when idle.

Fuel injectors are commonly used in today's automotive vehicles to replace earlier fuel feeding through carburetors. A fuel system generally has a fuel pump which may be either submerged in the fuel tank or positioned outside the tank, and which pumps fuel under pressure through the fuel line, to the fuel rail, into the fuel injectors. A fuel injector with a proper nozzle design sprays fuel mist at the air in-take manifold of a cylinder in an engine block. Fuel mist combined with air in proper ratio is drawn into an engine cylinder during the in-take stroke. An optimum air/fuel mix has a stoichiometric ratio of 14.7 to 1 that makes detonation easier and combustion more complete. Fuel injectors are located near (or inside) the engine cylinder at an elevated temperature. A spring loaded electro-mechanically controlled ball valve is used to seal off the nozzle of the fuel injector. This prevents pressurized fuel from seeping into the engine block when it is not running. Pressurized fuel reduces fuel vapor in the fuel line, which minimizes vapor lock; vapor lock may interfere with hot engine start-up. When an operator pushes the gas pedal, the pushing of the pedal is converted into an electric signal sent to a microprocessor. Together with the engine operating information from various sensors, the microprocessor then activates the fuel injector to deliver a pre-determined quantity of fuel to the engine cylinder through the fuel injection process.

The amount of fuel injected per pulse q is linearly proportional to the pulse width of the electrical pulse sent.

$$q = k(t - C) \tag{3}$$

$$\text{and } k \sim P^n \tag{4}$$

where q is the amount of fuel injected per pulse,
k is a constant that reflects the continuous injection rate per second,
t is the pulse width of fuel injection pulse,
C is a correction constant, and
n is a constant.

The continuous injection rate k is a strong function of fuel pressure P. The quality of sprayed mist also depends upon the design of the shape of the nozzle. To the first order of approximation, "n" is about ½. The actual value varies between ½ and ⅓ with the latter value toward higher pressure. In other words, to double the fuel injection rate under identical operating conditions, the fuel pressure must be increased by at least 4-fold. The linearity and reproducibility must be maintained to within 1% in the linear operating range to avoid irregular engine behavior when vehicles are mass-produced. The microprocessor receives information from various sensors in the engine and determines the pulse width based upon the amount of fuel needed.

In sequential multi-port injection, a fuel injector is mounted to the fuel in-take port to a given engine cylinder (or directly into the cylinder).

At full power, where maximum fuel injection is used, an exemplary engine is running at about 6,000 rpm. Fuel in-take strokes generally last only about 5 milliseconds. In the mean time, just "opening" and "closing" a spring-loaded ball valve physically takes more than one millisecond. This sets the minimum pulse width for fuel injection during idling to no less than 2 milliseconds. The fuel injection pulse width is thus limited by the time needed for operating a spring loaded ball valve and, as a result, may have an unpredictable amount of fuel injection and cause erratic engine performance. The typical linear range to operate a fuel injector is between 2 to 10 milliseconds, for a variety of different internal combustion engines. A manufacturer generally must choose the diameter of the nozzle at a given fuel pressure to achieve maximum power at a maximum pulse width. This limits the so-called dynamic range of the fuel injection system, as the system parameters need to be chosen to achieve the desired power with the available pulse width. As a result, fuel injection systems often have too much fuel injected at the lower end of the range, that is, where there is a minimum pulse width, when idling. Thus, the dynamic range of fuel injection has room for improvement.

For example, U.S. Pat. No. 5,355,859 to R. E. Weber changes the voltage applied to a fuel pump to generate and maintain variable fuel pressure. U.S. Pat. No. 5,762,046 to J. W. Holmes et al. uses a resistor in series with the fuel pump coil. By selectively bypassing the series resistor per control signal from the microprocessor, a fuel pump will have different applied voltages to create dual speed for the fuel delivery system. However, because a fuel pump generally has a large inductive load, varying the voltage applied to the fuel pump generally does not stabilize fuel pressure for a period of seconds. This delay in fuel pump stabilization in turn causes a delay in engine response and needs fine adjustment to compensate the voltage drop across the resistor in order to maintain smooth operation. Furthermore, since only a minute quantity of fuel is needed to keep an engine alive when idle, to assure the injection is operating within appropriate linear range, the fuel pump generally must run at very low speeds. To achieve such very low speeds in the fuel pump, the voltage applied to the pump generally must also be correspondingly low. When operated on such correspondingly low voltages, the fuel pump may run sluggishly, resulting in undesirable pressure fluctuations. Also, the pump may have a shorter life and decreased reliability if it runs at variable speeds with the associated frequent and sudden acceleration/decelerations of such variances.

The response time required to change the speed of the fuel pump is unacceptably slow in comparison to the fuel injection process. Since fuel metering depends on how much fuel is being delivered by the fuel pump, undesirable pressure fluctuation generally occurs at the time when fuel injection pulses are taking place. The attempts of the art to address the above-outlined drawbacks have had mixed results at best. Excess fuel supply, a pressure regulator, and a pressure gauge are often used to minimize the pressure fluctuation during fuel injecting. A pressure release valve and an excess-fuel-return line from the fuel rail are also installed to bleed the excess fuel accumulated in the fuel rail back to the fuel tank. The hot fuel returned to the fuel tank raises the temperature in the fuel tank during prolonged operation. Precautions are also needed to recover the hot fuel vapor in the fuel system.

SUMMARY OF THE INVENTION

A constant speed multi-pressure fuel injection system has been developed. The fuel system has a pump running at a constant drive (or at a constant speed) while at the same time multiple pressure levels are created through different means. It provides the capability to instantly increase fuel supply to an engine on-demand instead of waiting for the system to stabilize before being capable of delivering more fuel. The same system is also capable of delivering much less fuel to keep the engine running when idle to save fuel.

This invention describes the structure and process of fuel injection delivery systems which create multi-pressure-levels on-demand instantly by restricting the fuel flow at a given steady fuel pump speed. This increases the dynamic range of fuel injection and minimizes fuel pressure fluctuation. Hence, the same engine that incorporates the invention is capable of doing the following: (1) Delivering more power instantly at peak load on-demand, which accelerates the vehicle from stand still to 60 miles per hour in seconds; (2) Reducing the idle speed with the engine still running smoothly, which saves fuel, improves city-driving mileage, and further reduces exhaust when idle; (3) Not changing the fuel tank temperature regardless of how long the engine is in operation; and (4) Enhancing the life of the fuel pump because the pump is running at a constant speed without frequent acceleration/deceleration. Although fuel saving and exhaust control may not seem much to a single vehicle, the cumulative effect should be noticeable in a traffic jam, or anywhere large number of vehicles are crawling with engines running. The invention can be applied to internal combustion engines used in automobiles, airplanes, and diesel engines. Thus, it saves fuel to achieve better city-driving mileage. Most of the existing vehicles already in operation for years can also be modified with minimum effort to achieve a reduced idle speed and still be able to run smoothly. When the invention is applied to a large number of vehicles, the public can enjoy the cumulative effect of cleaner air in metropolitan areas.

By adjusting constrictions of fuel flow, the fuel injection system has a wider dynamic range (defined as the ratio of the maximum amount versus minimum amount of fuel injected per second) so that it can provide instantly very low yet steady fuel pressure to deliver a minute quantity of fuel to be injected per pulse to keep the engine running smoothly even at very low speed (or idle). The same fuel injection system can also provide additional fuel pressure on-demand instantly to deliver more power when the operator has to quickly accelerate. All of these functions are accomplished while the fuel pump is running steadily at a constant speed.

In addition, a fuel-return line diverts a small portion of fuel from the output of the pump (or from the main filter) to the fuel tank to stabilize the fuel system at the predetermined pressure. In other words, the fuel-return line system minimizes fuel pressure fluctuation caused by pump metering action. It also takes away the need to bleed the excess hot fuel at the fuel rail and return it to the fuel tank to avoid pressure built-up at the fuel rail. Without hot fuel returning to the tank, the temperature in the fuel tank will remain unchanged regardless of how long the vehicle is in operation.

Depending upon the operator's desire and sensor signals from the engine, such as, but not limited to, airflow, engine speed, torque, and temperature, the fuel system can be switched from one steady state to another state at a new pressure level almost instantly without changing the drive (or speed) of the fuel pump. The stabilization of fuel pressure allows a microprocessor to predict a proper fuel injection pulse width for delivering the desired amount of fuel per pulse. It also minimizes the guessing processes to deliver a proposed fuel quantity per pulse in the split injection process commonly used in a diesel engine.

An important objective of this invention is the capability to change the fuel pressure from one steady state to another state instantly and precisely, while the pump is running at a constant speed. The pressure at each state is steady with minimum pressure fluctuation. It assures a more accurate estimate of the amount of fuel to be delivered to the engine.

Another objective of this invention is to be able to change from a normal operating fuel pressure to a very low and steady pressure instantly with minimum ripple for idle and for low speed driving while the pump is running at a constant speed at a comfortable voltage.

A further objective of this invention is to instantly switch from normal operating pressure to a higher fuel pressure on-demand for quick acceleration without changing the driving voltage applied to the fuel pump.

Yet a further objective of this invention is to constantly circulate fuel through the fuel-return line to maintain a constant fuel pressure and to avoid excess fuel and pressure built-up at the fuel-rail. Thus, hot fuel from the fuel rail does not need to return to the fuel tank and the temperature in the tank will remain unchanged regardless of how long the vehicle is in operation. Constant fuel pressure also assures a more predictable amount of fuel injected per pulse.

All of these objectives can be achieved while the fuel pump is running at a constant speed (or the drive voltage applied to the fuel pump is set at a constant value well within a comfortable linear operating range of the fuel injector). Because the fuel pump is not subjected to frequent and sudden acceleration/deceleration, the life of the pump may be prolonged.

In the drawings, which are discussed below, one or more preferred embodiments are illustrated, with the same reference numerals referring to the same pieces of the invention throughout the drawings. It is understood that the invention is not limited to the preferred embodiment depicted in the drawings herein, but rather it is defined by the claims appended hereto and equivalent structures.

BRIEF DESCRIPTION OF THE DRAWINGS

FIG. 6 is a flow chart that shows the operations of the invention when an operator desires instant maximum power on-demand.

DETAILED DESCRIPTION OF THE PREFERRED EMBODIMENTS

While the specification concludes with claims particularly pointing out and distinctly claiming the subject matter which is regarded as the invention, the invention will now be further described by reference to the following detailed description of preferred embodiments taken in conjunction with the above-described accompanying drawings.

Figure 1:
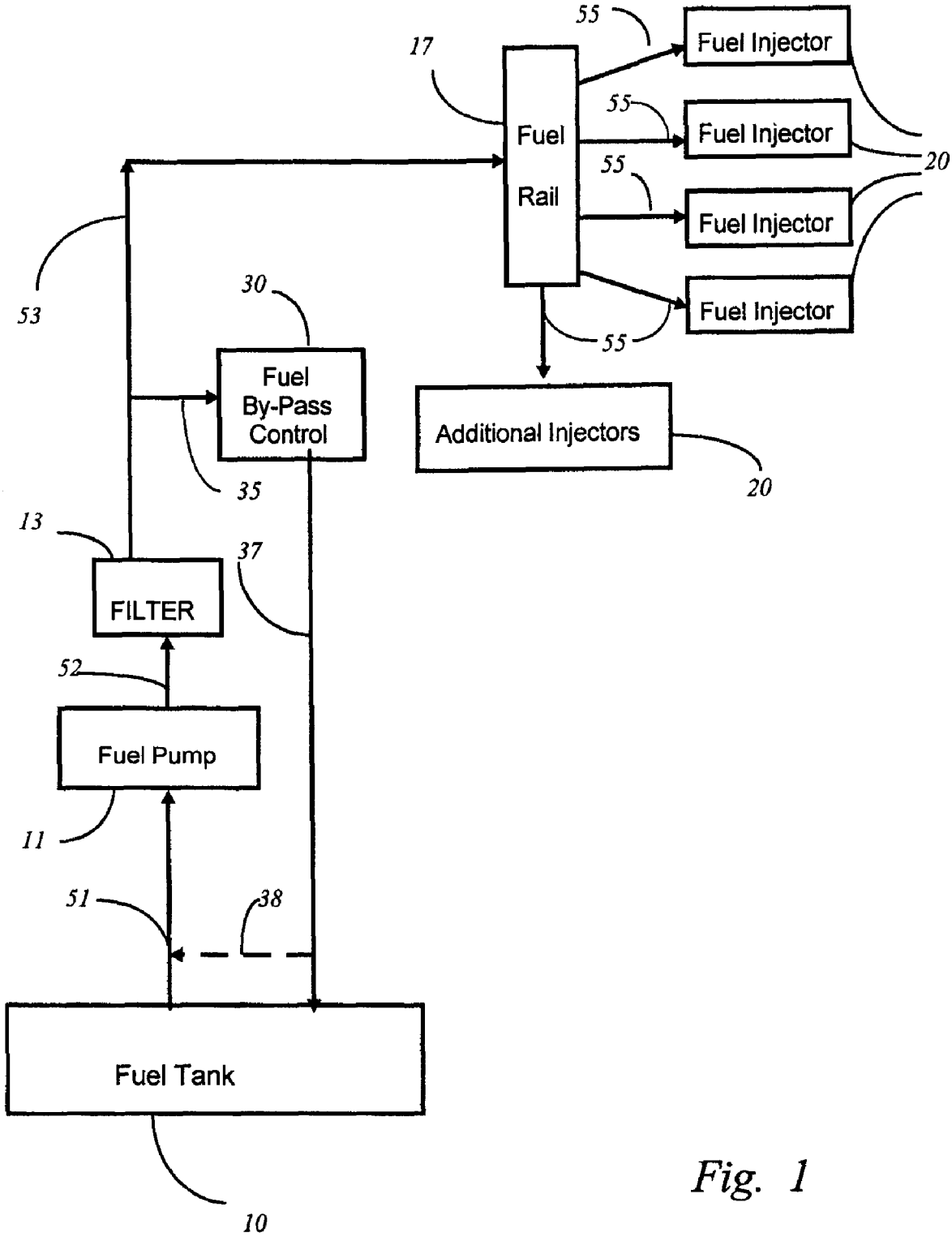
FIG. 1 is a schematic drawing of a dual pressure fuel injection delivery system according to the present invention.
Figure 2:
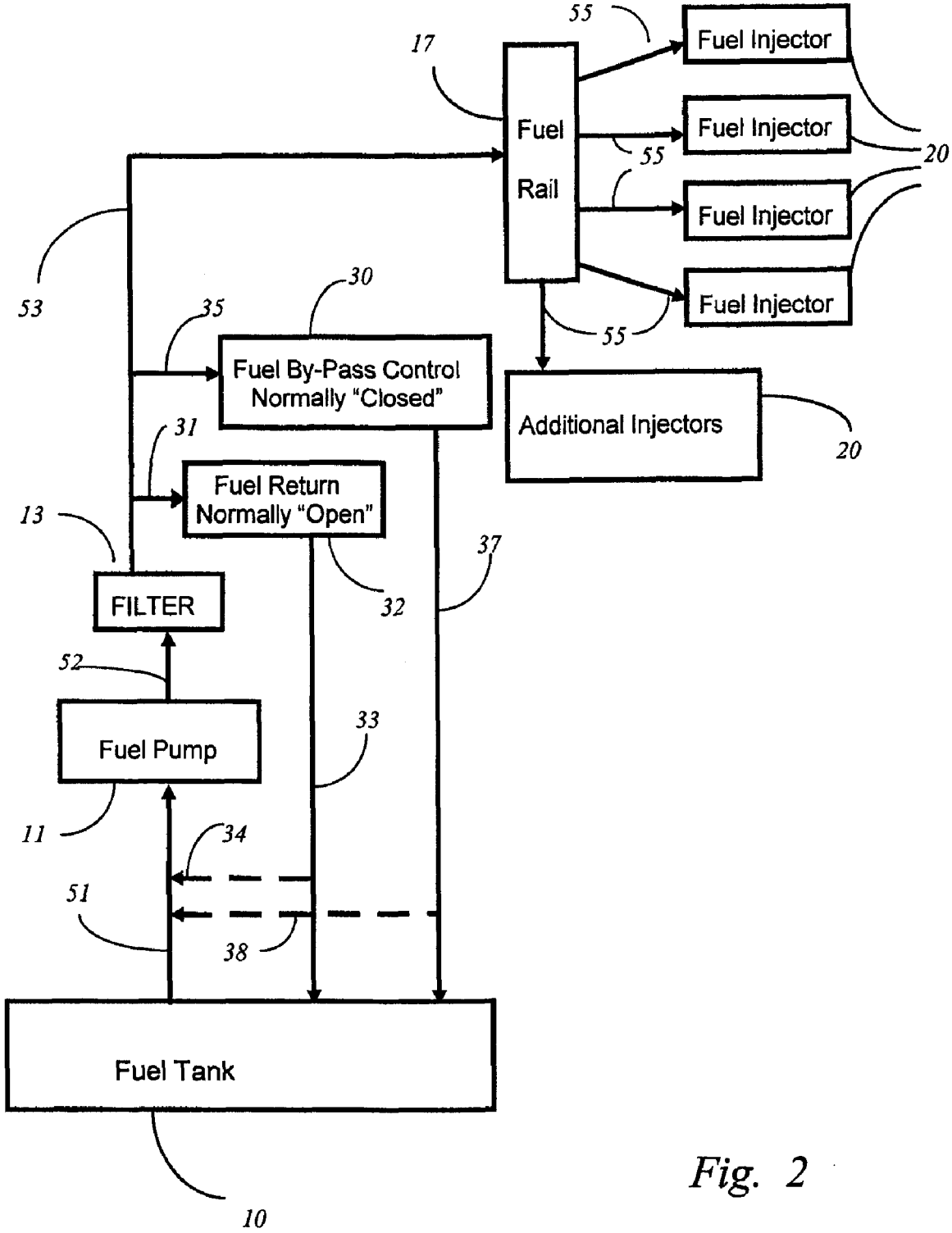
FIG. 2 is a schematic diagram of a multi-pressure fuel injection delivery system that uses a Fuel-Return Line to stabilize fuel pressure according to the present invention.
Figure 5:
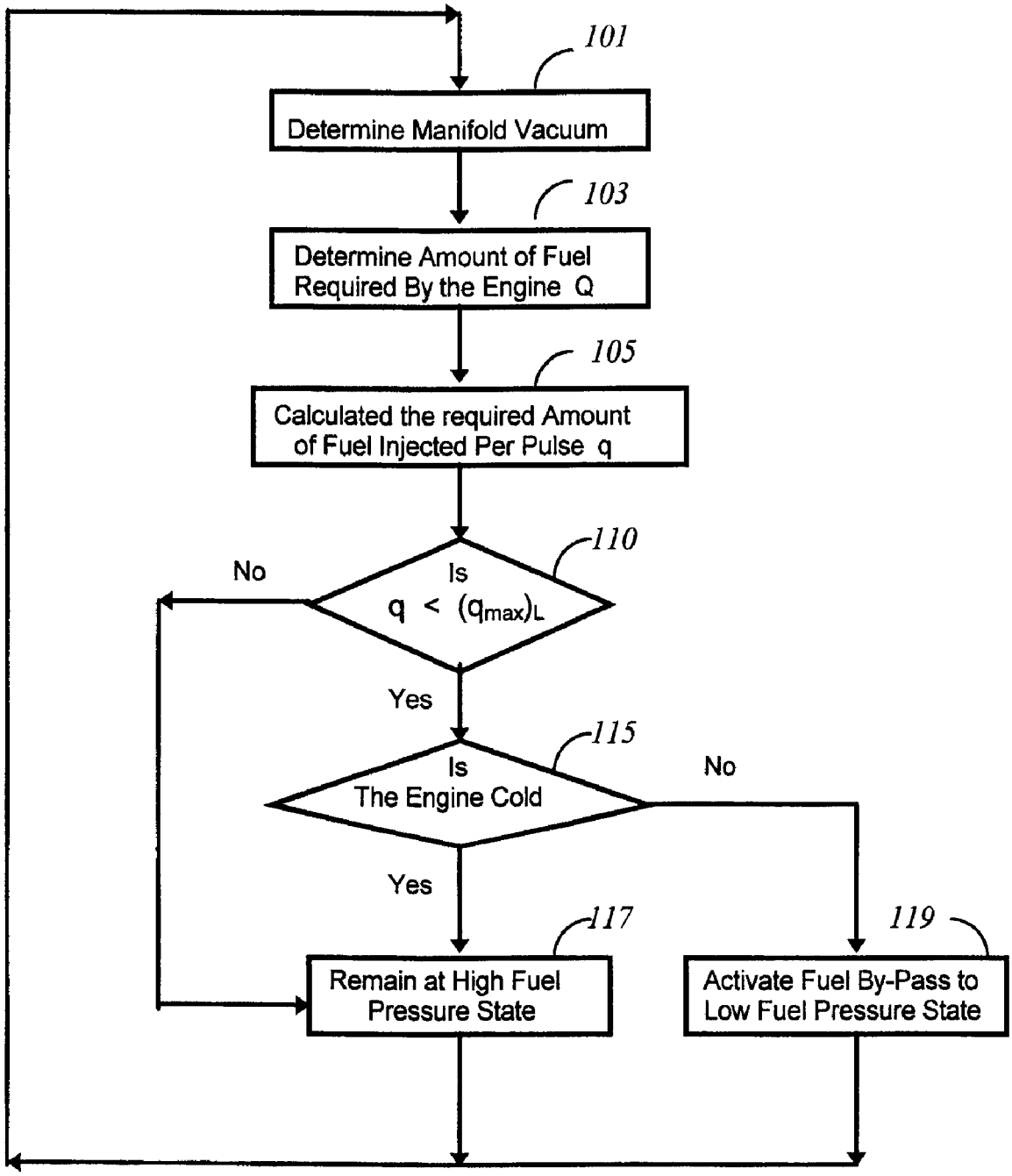
FIG. 5 is a flow chart of a microprocessor electronic signal execution sequence that shows the operation of a dual pressure single speed fuel injection delivery system according to the present invention.

The structures of fuel injection systems of the current invention are shown in FIG. 1 and FIG. 2. The illustration of its operations and its properties will refer to both figures. Not shown in those figures yet well understood to technical professionals in microelectronics is the set-up of microelectronics used to control the system. An embedded controller, a microprocessor, or a programmable logic circuit can be used as the brain. It may be a standalone unit, or a subroutine of the Engine Management Control (or ECU) of the vehicle. The program may be embedded in ROM, PROM, EPROM, or other conventional storage media like hard disk, CD-ROM, tape drive, etc. The program is executed by the microprocessor through the RAM. The sequence and logic of the control are shown in FIG. 5 and FIG. 6.

A. Basic Fluid System that Creates Dual-Pressure Instantly

FIG. 1 is one embodiment of the invention. The inventive fuel injection fluid system comprises the following parts: fuel tank 10; fuel pump 11 (which may be submerged in the fuel tank, or installed outside the tank); main fuel filter 13; fuel supply lines 51, 52, 53, 55 which connect the various components of the system in fluid communication; fuel rail 17 to which all of the fuel injectors 20 are connected; fuel by-pass control 30; and fuel by-pass lines 35, 37 which feed the extra by-pass fuel from the main fuel line 53 to fuel tank 10 or through line 38 to the fuel in-take line 51 to the fuel pump 11 for re-using in the fuel injection process. Fuel pump 11 runs at a constant speed well within the comfortable operating range of a pump.

Fuel by-pass control 30 preferably has an electromechanically controlled valve (normally closed or open depending upon its operation). Lines 35, 37 and by-pass control 30 comprise a by-pass for fuel to be partially diverted from the main fuel line 53. When fuel by-pass control 30 is normally closed, fuel pump 11 supplies fuel to the fuel injectors only. When by-pass control 30 is open, fuel pump 11 will deliver additional fuel to be by-passed through fuel lines 35, 37 back to fuel tank 10 (or pass through line 38 to fuel in-take line 51 to fuel pump 11.)

Proper restrictions are imposed on the by-pass fuel flow outlined above. For example, one may choose the size of the fuel by-pass lines 35, 37, 38 so that they provide proper flow resistance or introduce a restriction by other means. For those familiar with fluid control, the means include, but are not limited to, using a needle valve or a diaphragm-like plate with a hole that has a proper diameter for fuel restriction. Regardless of what the state of fuel by-pass control 30 is in (open or closed), fuel pump 11 runs continuously under a constant voltage drive (or at a constant speed). The changes in the fuel flow rate through the fuel pump under a constant drive create different steady fuel pressure states for the fuel supply system.

Figure 3:
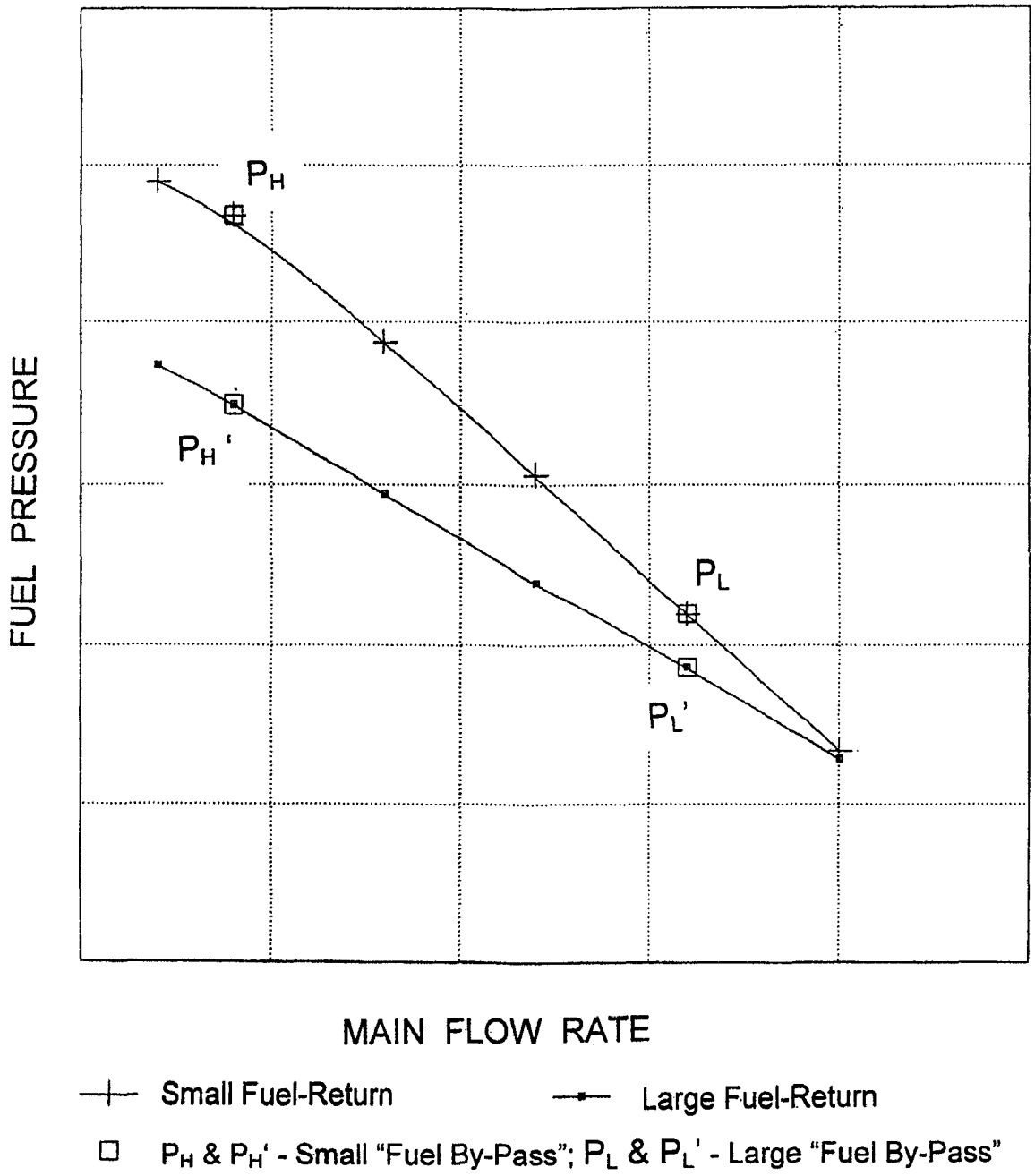
FIG. 3 is a representative relationship between fuel pressures versus the total fuel flow rate through a fuel pump at a constant speed in a fuel system like those shown in FIG. 1 and FIG. 2 according to the present invention.

A fluid system has certain similarities to an electrical circuit, where the fuel pump is equivalent to a power source and the fuel flow rate is equivalent to current in an electrical circuit. The fluid supply system as a whole provides a steady state impedance to the pump. When the fuel by-pass control is closed (normal operating condition), the fluid system is stabilized at a quiescent state at pressure $P_H$ for a given fluid flow rate $F_1$ (FIG. 3). When fuel-by-pass control 30 lets additional fuel $F_2$ flow through fuel by-pass lines 35, 37 to fuel tank, more fuel is fed through the fuel pump creating a new quiescent state at a lower pressure $P_L$ as shown in FIG. 3. Similarly, if the fuel by-pass control is normally open, closing the fuel-by-pass control will reduce the amount of fuel flowing through the pump. This will switch the pressure of the fuel system from the quiescent pressure state $P_L$ to a higher quiescent pressure state $P_H$. The switching over between the pressure states is quick in just a few milliseconds which is the time for the pressure wave to travel from the control valve to fuel injectors at the acoustic velocity of fuel. The pressure spike and multi-reflection of pressure waves will be over in about one or two revolutions at 3,000 rpm (instead of fractions of a second in most on-demand systems). Thus, it makes predictions to obtain the required amount of fuel per injected pulse a lot easier.

In this invention, the higher fuel pressure $P_H$ is set for start-up and normal operation, and the maximum pulse width (about 10 milliseconds) is set for the nominal maximum power (or slightly more). When the vehicle is operating in idle or driving at slow speed, the fuel-by-pass control is switched to open. This makes the fuel system operate at a lower pressure state $P_L$ while the fuel pump is running at the same speed as before. Because not much fuel is needed other than keeping the engine alive when the vehicle is idling, a manufacturer can set fuel injection pulse width at a minimum rate (about 2 milliseconds) and set a constraint on the fuel-by-pass line to obtain the lowest fuel pressure $P_L$ which accomplishes the fuel spraying properly and allows the engine still to run smoothly. The amount of fuel injected can be very small so that it barely keeps the engine running while still running the engine smoothly.

The action to open or close the fuel by-pass control can be done manually by flipping a control switch. It can also be controlled using an embedded controller where an electronic signal is sent to activate a control circuit which activates the actuator of the fuel by-pass control switch. Suitable programming logic is used by the controller, the steps of which are shown in the flow-charts of FIG. 5 and FIG. 6, and the operation of which is discussed subsequently in section D.

Figure 4:
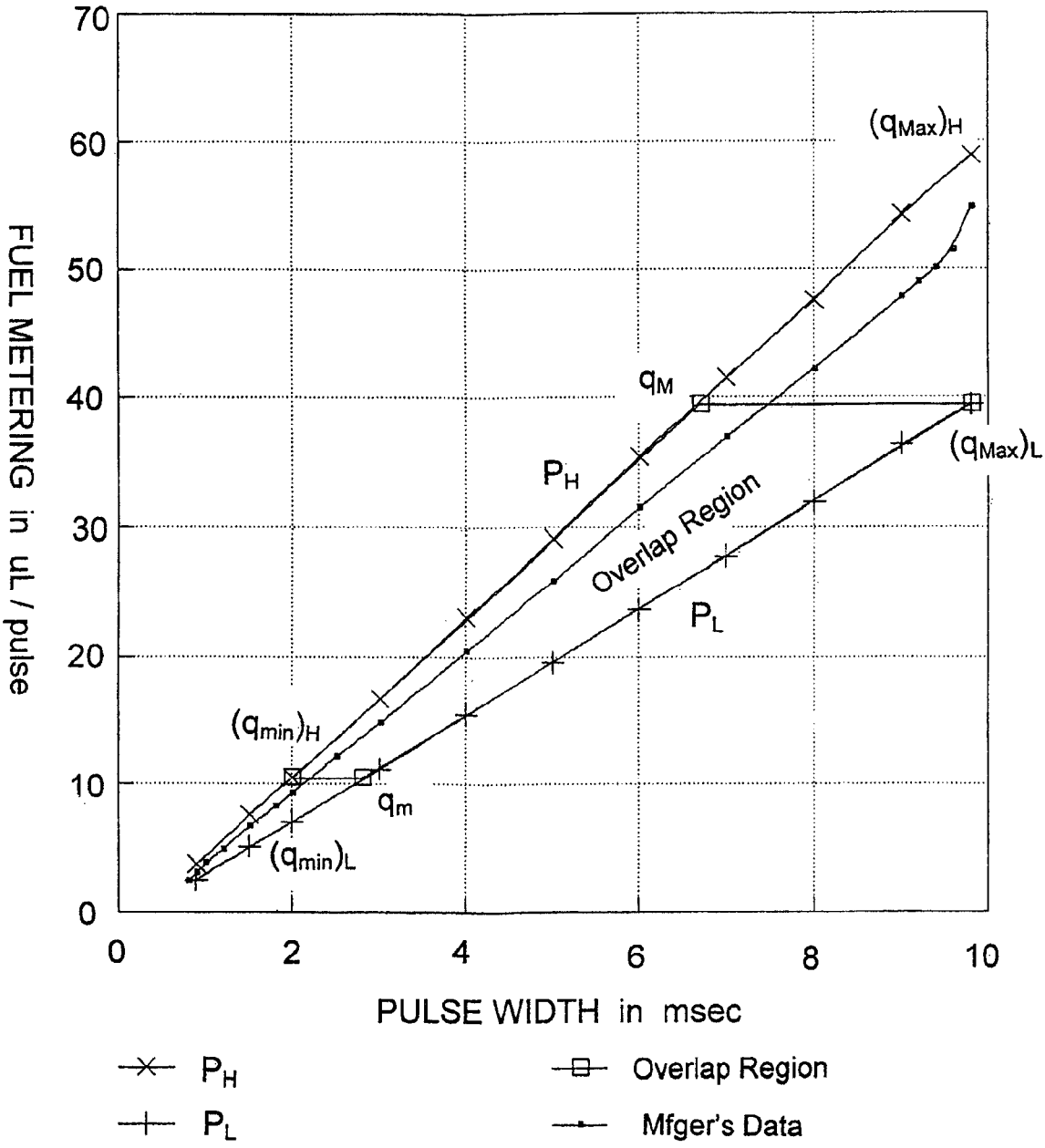
FIG. 4 is a typical fuel injection event between fuel injected per pulse and pulse width under different fuel pressures and constant pump speed.

Generally, under a given quiescent fuel pressure P, a fuel injector operating within its linear range (typical pulse width about 2- to 10-milliseconds) has a dynamic range as shown in FIG. 4 by the plotted points therein. Superposition of two linear operating ranges under two different fuel pressures will make the dynamic range wider (also shown in FIG. 4), where the smallest fuel injected per pulse $(q_{min})_H$ under higher pressure $P_H$ at minimum allowed pulse-width is equal to or less than the highest fuel injected per pulse $(q_{Max})_L$ under lower fuel pressure $P_L$ at maximum pulse-width, i.e. $(q_{min})_H < (q_{Max})_L$. As a result, the design team can assign the higher pressure $P_H$ for start-up, normal operation, and choose the pressure so that maximum nominal power is achieved at the longest allowed pulse width; the lower pressure $P_L$ for city driving and for idling can also be assigned. The pressure $P_L$ is tuned for idle so that the smallest fuel injected per pulse $(q_{min})_L$ under the shortest allowed pulse width makes the engine run at the slowest possible speed yet still run smoothly. Hence, it reduces fuel consumption when idle and increases the dynamic range of fuel injection. When the desired amount of fuel injected per pulse q is within the overlapping region, $$\text{i.e., } (q_{Max})_L > q > (q_{min})_H,$$

two values of pulse width exist for any given q. The design team chooses between higher pressure $P_H$ and lower pressure $P_L$ depending upon the expected driving condition and for a smooth transition without feeling roughness during the transition of pressure switching over. For those who are familiar with the state of the art of the technology, many alterations and combinations to the values for q, $P_H$, and $P_L$ can be selected for different applications. The voltage applied to the fuel pump can also be changed to create different sets of pressure P. The combination of the new fuel system design and the changes in applied voltage will provide enough flexibility for any vehicle to run smoothly from the fuel injection point of view.

FIG. 4 is a typical relationship between the amounts of fuel injected per pulse q versus pulse width in a dual pressure fuel injection system. In comparison with the actual fuel injection measurement by a fuel injector manufacturer for a 2.0-liter displacement engine, a dual pressure fuel injection system is capable of delivering more fuel injected per pulse at maximum pulse width $(q_{Max})_H$; the system is also capable of delivering less fuel per pulse at minimum pulse width $(q_{min})_L$ when the driver releases gas pedal, i.e., $$(q_{Max})_H > q_{Max}, (q_{min})_L < q_{min};$$

$$\text{and } (q_{Max})_H/(q_{min})_L > q_{Max}/q_{min} \tag{5}$$

Using the dual pressure injection system can save fuel when compared to actual single pressure injection. For example, FIG. 4 shows a 25% fuel saving per pulse in a multi-point sequential injection when driver releases gas pedal (compared to the actual data from an injector manufacturer). That means the same vehicle will consume about 40% less fuel per second when the engine reaches equilibrium at idle speed according to Eq. (2). It also means that the vehicle will generate 40% less auto emission which improves city-driving mileage. Although fuel saving and exhaust reduction may not seem much to a single vehicle, the cumulative effect on a congested highway or during a traffic jam in a city street where hundreds to thousands of vehicles are crawling, the affect will be noticeable. It would provide a lot of comfort to drivers, to people walking on the street, and to residents living nearby.

B. Fuel-Return Line for Fuel Pump Stabilization Temperature Stability in Fuel Tank, and Delivering An Instant Excess Power On-Demand Using the same principle as described in the previous section, we can further improve the fuel injection fluid system by adding an extra fuel-return as shown in FIG. 2. Fuel-return-line 31 is connected from the output of fuel pump 11 (or at the output of filter 13) through fuel-return-control 32 (which is normally "Open"), line 33 back to fuel tank 10 (or through line 34 to intake line 51 of the fuel pump). Line 33 may also be connected to line 37 to decrease the cost. Fuel-return-control 32 can be an electro-mechanical valve, which may be controlled manually or electronically by using a microprocessor or an embedded controller. The amount of fuel through fuel-return may be adjusted to obtain different high pressure $P_H$ as shown in FIG. 3 where two linear lines represent two different pressures. If the flow of the fuel-return is larger than the flow for fuel injection, the structure will regulate the pressure of the fuel system to be almost constant.

The structure minimizes the dependence for the fuel pump to provide the exact amount of fuel for fuel injection and eliminates the need to return the unused excess fuel from fuel rail 17 (hot fuel) to fuel tank 10 to avoid pressure built-up. The structure also reduces the critical dependence to a fuel regulator, which contains numerous high-precision mechanical parts. Hence, the small amount of the fuel through a fuel-return line 31, 33 can stabilize the pressure and make the operation of the fuel pump steady. This minimizes the pulsating pressure spikes during fuel metering. Since no more hot fuel is returned to the fuel tank, fuel temperature in the fuel tank will remain unchanged regardless of how long the vehicle is in operation.

The amount of flow restriction imposed by fuel-return line 33 determines the value of the first quiescent pressure $P_H$. Typically, the lower the amount of fuel flowing through the fuel-return line, the higher the quiescent pressure $P_H$ will be. FIG. 3 has two plotted lines representing two different pressures $P_H$ which are created by a different amount of fuel-return. In addition, should there be a desire for the operator to obtain excessive power in a hurry, the ECU can electro-mechanically cut off the flow through fuel-return-lines 31, 33 and fuel-by-pass-lines 35, 37 resulting in a quick increase in fuel pressure for a short duration which delivers additional maximum power on-demand instantly for quick acceleration. The electro-mechanical "Off/On" action may be directed by a microprocessor or be controlled manually. Details on how to incorporate signals from various sensors to control the fuel pressure states and to determine the amount of fuel injected will be discussed in Section D and shown in a flow chart in FIG. 6.

C. Fuel Injection System that Incorporates Both Inventive Features

FIG. 2 is a complete fuel injection supply system that incorporates both features of the invention using fuel-by-pass control 30 (normally closed) and fuel-return control 32 (normally open). With fuel-return-control 32 normally open, the fuel pump is stabilized and there is no need to return hot fuel to the fuel tank. With fuel by-pass control 30 normally closed, the fuel injection system is similar to today's existing fuel injection supply systems, except that it is optionally designed to operate at a higher pressure $P_H$ than normally available with the more limited dynamic range of current systems. The operation under normal setting is similar to that in today's vehicles. It will be used for start-up, normal driving, engine warm-up, etc. Yet, when the engine has warmed up and the vehicle is being used for city (urban) driving or is idling, the fuel-by-pass control 30 can be opened electronically, which switches the fuel pressure from a higher pressure $P_H$ to the lower pressure $P_L$. The vehicle will be operating in the fuel saving mode and will reduce auto emission. Because the new system has a wider fuel injection dynamic range, as mentioned above, $P_H$ can be set slightly higher so that the same engine can deliver a little more power, yet the same engine can still reduce fuel consumption when the gas pedal is released including idle to improve city-driving mileage and achieve fuel emission reduction.

Should the operator or system designer have a strong desire for instant high power on-demand, the system is structured to respond by closing both fuel-by-pass control 30 and fuel-return control 32 for quick acceleration. Such an operation may exceed the rating of the engine. Hence, the system should preferably allow the operator, or be otherwise designed, to perform such an operation under emergency bases and only for short time periods.

D. Flow Chart of the Microprocessor Controlled Fuel Injection Supply System

In a fuel injection supply system as shown in FIG. 2, a microprocessor is preferably used for collecting the input information from various sensors and executing the operating sequences. The microprocessor may be a standalone unit, multiple embedded controller units to execute more extended features, or shared with the main CPU (Engine Management Control, ECU, or ECM unit) to execute the fuel injection subroutine. One set of the I/O ports from the microprocessor is designated to receive sensor signals in regard to engine temperature, engine speed, engine power and torque, fuel pressure, throttle position, air flow and pressure, etc. Another set of I/O ports are connected to storage devices, such as ROM, PROM, EPROM, hard diskette, floppy diskette, CD-ROM, etc. The storage media are used to store the chart of fuel injection requirements, engine operating parameters, and the embedded program for executing the fuel injection control processes. All processing and calculations are done in the RAM also attached to the third set of I/O ports of the microprocessor. The last set of I/O ports is designated as the control signal outputs. The output signals are used to trigger the actuation circuits for valve action control.

FIG. 5 is a microprocessor electronic signal flow chart for the fuel system as shown in FIG. 1 where the fuel by-pass control is normally closed. The microprocessor detects the needs of the engine and measures the pressure differences between air manifold (not shown) and fuel rail in step 101, determines the amount of fuel needed by the engine Q in step 103, calculates the required amount of fuel injected per pulse q in step 105, and determines the pulse width for the fuel injected per pulse q in step 120. In decision block 110, if the calculated q is less than the maximum amount of fuel injected per pulse under the low fuel pressure state $q<(q_{max})_L$ and the engine is warm, according to decision block 115, the microprocessor will send an electronic signal to activate the control circuit that actuates fuel-by-pass control valve to open (step 119). This switches the fuel system to a lower fuel pressure state $P_L$. On the other hand, if $q>(q_{max})_L$ 110 or the engine is cold, fuel-by-pass-control stays Closed. Fuel pressure will remain in the higher-pressure state $P_H$, as indicated by 117. In either pressure state, the microprocessor will detect the new fuel pressure and determine the pulse width for the fuel injected per pulse q (step 120) in the next fuel injection cycle.

An electronic pulse of the pulse width is sent to a control circuit (not shown in the FIG. 5) that actuates the fuel injector valves under the pre-determined pulse width. Sensor signals of the actual engine performance are collected and used to compare with the original data of the anticipated results. The microprocessor makes proper adjustment and determines the revised pulse width, then sends the next round of control signals.

FIG. 6 is an electronic signal flow chart for the fuel system as shown in FIG. 2 where the fuel by-pass control is normally closed and the fuel-return control is normally open. Fuel-return is installed to stabilize the fuel pump operation and to minimize the pressure fluctuation of the fuel system. The fuel-return control is normally open. Hence the flow chart for the control processes of fuel-by-pass is the same as those shown in FIG. 5. However, when the operator has a strong desire to demand maximum power instantly 150, 151, 152, the signal from the pedal position sensor is compared with the maximum electronic signal from gas pedal position sensor $V_{gas}=(V_{gas})_{Max}$ repeatedly for N-times as shown in step 153, where N is pre-set and may be in the range of 30 to 100 to assure the validity of the urgent needs. If the engine is not over-heated 154, the microprocessor will send a flag 155 to over-ride any command to the fuel injection system, close the fuel-return control and fuel-by-pass control, over-ride the engine temperature sensor "Warm/Cold," and send a maximum pulse width signal to the fuel injectors. This is the only time the fuel-return is activated to close and extra fuel pressure is added to the system to deliver additional amount of fuel per pulse for extra maximum power. Simultaneously, the microprocessor will trigger Engine Management Control to open fully all throttle valves, turbo charger, supercharger, and coordinate its operations to allow in-take air to flow at its maximum.

The only overriding signal occurs when the engine is overheating. In that case, the fuel-return valve will remain Open and the fuel-by-pass valve is closed. The fuel system will stay at a higher-pressure state $P_H$. Because the engine may operate beyond its normal rating, the operation as described in FIG. 6 should only be operated for a short time, i.e. $t<t_{allowed}$. The design team can pre-set the allowed time $t_{allowed}$, which may be in the range of 10 to 60 seconds. When the operation exceeds the pre-set time $t>t_{allowed}$ 163, the controller will open fuel-return 164. All of process 165 will follow the flow chart as shown in FIG. 5.

E. Modification of Vehicles Already In-Use for Improved City-Driving-Mileage & Reduced Auto Exhaust Any vehicle already in use which uses a single pressure fuel injection system can be modified easily to include the present invention and thereby increase its city-driving mileage, save fuel, and reduce auto exhaust emission. The modification adds an electromechanical fuel-by-pass control 30 (normally closed) and fuel by-pass lines with flow constraint 35, 37 that connect from the output of fuel filter 13 (or output of fuel pump 11) to fuel tank 10 (or to the fuel in-take line 51 to fuel pump 11) as shown in FIG. 1. For vehicles that have a hot fuel return line from a fuel rail, the fuel by-pass line may be connected from the output of the fuel pump to the hot-fuel-return line for easier modification and cost saving.

Fuel by-pass control 30 is normally closed. The modification will not affect the normal operations of the existing vehicle. When the vehicle is being used for city driving or is sitting idle, the fuel by-pass control will be open. Fuel by-pass lines 35, 37 add extra fuel through the fuel pump resulting in a reduced steady pressure $P_L$. Hence, less amount of fuel will be injected per pulse for the same pulse width. This reduces engine idle speed, saves fuel, improves city-driving mileage, and reduces auto emission. The modification is simple and inexpensive. The benefits are especially significant in metropolitan areas where large numbers of vehicles are in operation.

It is well known that air and fuel must be mixed close to stoichiometric all the time for complete combustion and power over the entire operating range of fuel injection. The systems described above use one or two fuel by-pass paths (generic) in one of four configurations using flow restraint to stabilize fuel pressure and binary valves to create multi-pressure levels off line. During operation, the Engine Management Control constantly adjusts the opening of the throttle valve and operations of air accessories, such as a turbo charger, super charger, and coordinate the operations continuously to provide adequate air supply in response to changing fuel demand at various pressure levels.

One of the distinctive advantages of the systems described above in comparison with today's on-demand fuel injection system is the quick response (or speed) to pressure level switching, where the effect of switching is only a few milliseconds in the present systems. The pressure spike and multi-reflection of pressure waves will be over in about one or two revolutions at 3,000 rpm (instead of fractions of a second in most on-demand systems). Thus, in an example using the present system, an engine rated for 220 HP maximum power in highway driving is capable of operating like a 70 HP engine to save fuel and reduce exhaust emission in city driving. The same engine with air accessories, such as a turbo charger, supercharger, and a heavier duty fuel pump, is capable of delivering a burst of 310 HP power instantly for a short duration when there is urgent need for power producing a sport-car-like performance.

As discussed in the last paragraph, Section A in the description above, about one third of fuel will be saved every time the gas pedal is released including idling. That reduces about one third of the gap between city-driving and highway-driving mileages; or about 3 miles per gallon more in city driving mileage. A pre-fabricated kit at low cost can also be used to plug-in into the main fuel line to upgrade most existing vehicles already in-use. America has more than 230 million units of light vehicles in-use as of 2005. If similar technologies are used, potentially 5.6 billion gallons of fuel (or 340 million barrels of crude oil) a year will be saved. That translates to 950 billion cubic feet of $CO_2$ a year (or 10 million tons of pollutants a year), which will be removed from the air in metropolitan areas. The reduced smog would provide cleaner air to greatly benefit millions of people living in the crowded metropolitan areas.

The system described above provides different fuel pressure levels under a constant fuel pump speed and has been described with reference to certain internal combustion engines. However, the system can be applied to any number of internal combustion engines or other engines making use of a fuel injection system. As such, the systems described above are applicable to diesel engines and aircraft engines that use fuel injection processes. One skilled in the art would have no difficulty applying the systems described above to other kinds of engines.

Additional advantages and variations will be apparent to those skilled in the art, and those variations, as well as others which skill or fancy may suggest, are intended to be within the scope of the present invention, along with equivalents thereto, the invention being defined by the claims attended hereto.

The claims are:

1. A method of controlling a fuel injection system of an internal combustion engine having an engine control module and a fuel pump for supplying pressurized fuel from a reservoir through a fuel line to a plenum in fluid communication with at least one fuel injector controlled by electronic pulse width to inject fuel pulses q to the engine, wherein the fuel injection system includes two fuel by-pass paths operable to divert a portion of the flow of fuel from the fuel line upstream of the plenum back to either the reservoir or an inlet of the fuel pump, each by-pass path having a binary control valve and a flow constraint provided by an orifice of predetermined diameter, a needle-valve-like device, or a device compressing the fuel by-pass path, wherein a first fuel pressure level $P_{H1}$ in the fuel line is defined when the control valve of only one of the two fuel by-pass paths is closed, a second or the highest fuel pressure level $P_{H2}$ in the fuel line is defined when the control valves of both fuel by-pass paths are closed, and a third or the lowest fuel pressure level $P_L$ in the fuel line is defined when the control valves of both fuel by-pass paths are open, the method comprising the steps of:

A. setting a fuel pump drive, voltage or current, for operating the fuel pump at a predetermined substantially constant speed;

B. communicating with the engine control module:

detecting engine operating conditions, including but not limited to fuel pressure, engine speed, vehicle speed and throttle position, while the engine is running;

determining the engine fuel demand Q and amount of air flow for the engine, and coordinating operations including throttle valve and air accessories, turbocharger or supercharger, to provide the amount of air flow for adequate fuel/air mix in accordance with the detected operating conditions;

C. calculating the size of the fuel pulses q for satisfying the engine fuel demand Q;

D. detecting the fuel pressure level in the fuel line;

E. determining the electronic pulse width for the fuel pulses q to be sent to the fuel injector at the detected pressure level in accordance with the fuel demand Q; and F. selecting one of the three pressure levels so that varying pulse width at the selected pressure for fuel pulse q operable within the full range of detected driving conditions for the next fuel injection cycles until the driving condition changes.

2. The method of claim 1, wherein the engine further includes a controller operable in response to receipt of signals indicating the operating conditions, vehicle speed, engine speed and throttle position to actuate the fuel injector to: deliver the fuel pulses q, select from among the three pressure states, and vary the electronic pulse width to control the size of injected fuel pulses q.

3. The method of claim 2 wherein the controller is operable to calculate the size of fuel pulses q in step C and determine the pulse width at the detected pressure level.

4. The method of claim 1 wherein activation of the binary control valves produces a rapid switching among the pressure levels, and wherein the electric pulse widths determined in step E before and after, respectively, the pressure switching between the fuel pressure levels, produce substantially the same size injected fuel pulses q.

5. The method of claim 4 wherein following a few engine revolutions after the opening of a binary control valve, the electric pulse width PW is increased to a level greater than a steady state pulse width $(PW)_L$ at pressure level $P_L$, to minimize pressure spikes and pressure wave reflections during opening of the binary control valve.

6. The method of claim 4 wherein following a few engine revolutions after the closing of a binary control valve, the electric pulse width is decreased to a level less than a steady state pulse width $(PW)_H$ at pressure level $P_H$, to minimize pressure spikes and pressure wave reflections during closing of the binary control valve.

7. The method of claim 1 comprising starting the engine at the first pressure level $P_{H1}$ with a normally closed one of the control valves in its closed state and the other normally open control valve in its open state, thereafter opening the normally closed control valve to instantly reduce the pressure to the third pressure level $P_L$ for city driving where vehicle is at low speed and stop- and-go is frequent; and closing the normally closed control valve to instantly return the pressure to the first pressure level $P_{H1}$ for normal highway driving where the vehicle is at high speed and rarely stops.

8. The method of claim 7 further comprising closing both control valves to instantly elevate the pressure level to the second pressure level $P_{H2}$ producing extra power on demand for a limited period in respond to urgent needs for power in the enhanced power drive mode.

9. The method to stabilize the second or the highest fuel pressure level $P_{H2}$ of claim 1 comprising adding a fuel return line with flow restraint in parallel with the two fuel by-pass paths to divert a portion of fuel flow from main fuel line, not entering the plenum, back to the reservoir or inlet of fuel pump, thus stabilizing the fuel pressure level $P_{H2}$ when both or all fuel by-pass paths are closed.

10. The method of claim 9, including changing the highest fuel pressure level $P_{H2}$ when all or both fuel by-pass paths are closed, comprising the steps of:

closing all fuel by-pass lines, and changing the amount of flow restraint in the fuel return path including replacing the flow restraint by a new flow restraint of different value, thus changing the amount of fuel flow through fuel return line to change fuel pressure from $P_{H2}$ to another pressure level ($P_{H2}'$).

11. The method of claim 9, including changing the highest fuel pressure ($P_{H2}$) comprising the steps of:

closing all fuel by-pass lines, and re-setting the fuel pump speed from the initial predetermined substantially constant pump speed to a second predetermined substantially constant speed to change fuel pressure level from $(P_{H2})_1$ to another pressure level $(P_{H2})_2$.

12. A method of using system of claim 1 for a vehicle engine having a high pressure regulator stabilizing fuel pressure at $P_{H2}$ in its fuel injection system, which has a fuel pump sending pressurized fuel from fuel reservoir through main fuel line to a fuel plenum in fluid communication with at least one fuel injectors, comprising:

installing two fuel by-pass lines, each with flow constraint and a binary control valve, to divert a portion of fuel flow from main fuel line through one or both fuel by-pass lines to the reservoir or the inlet of fuel pump, setting fuel pump to run at a pre-determined substantially constant speed Ω, opening binary control valves in both fuel by-pass lines to instantly reduce fuel pressure to a pre-set level at $P_L$ for city driving to lower emissions in metropolitan areas, closing the binary control valve in one of the fuel by-pass lines to instantly change fuel pressure to a pre-set level at $P_{H1}$ for normal highway driving for improved fuel economy; and closing all fuel by-pass lines creating the highest fuel pressure regulated by the high pressure regulator at $P_{H2}$ already installed in the vehicle as the power driving mode for performance.

13. The method of claim 12 wherein the fuel pump is set at a first pre-determined substantially constant speed $\Omega_1$ enough to supply fuel to injectors for normal highway driving at $P_{H1}$ and for city driving at $P_L$ , but may not be enough to supply fuel for operations at $P_{H2}$ for the enhanced power drive mode, further comprising the following steps;

setting fuel pump to run at a pre-determined substantially constant speed $\Omega_1$ so that enough fuel is supplied at $P_{H1}$ for regular highway driving and at $P_L$ for city driving;

closing both fuel return and fuel by-pass paths to raise fuel pressure quickly in response to urgent need for power, and simultaneously setting fuel pump at the second pre-determined substantially constant speed $\Omega_2$ where $\Omega_2>\Omega_1$ to stabilize its pressure at $P_{H2}$ set by high pressure regulator, where $P_{H2}>P_{H1}>P_L$, so that enough fuel is supplied at $P_{H2}$ as the power drive mode for performance.

14. The method of creating an Eco-Friendly engine using smaller engine for improved fuel economy in highway driving and lowered emissions in city driving, and still able to produce instant super power on-demand, wherein the fuel injection system has at least two fuel by-pass lines to selectively divert portions of fuel from the main fuel line not entering the plenum, through one or two fuel by-pass paths, back to the inlet of fuel pump or reservoir, instantly creating at least three stable pressure levels, namely $P_{H2}$, $P_{H1}$, $P_L$, wherein $P_{H2}>P_{H1}>P_L$, comprising the following operating steps:

setting fuel pump at a pre-determined substantially constant speed before, during and after the pressure switching;

communicating with an Engine Control Module ECM, wherein ECM receives sensor signals on engine operating parameters, including engine speed, driving conditions, vehicle speed, and changes of gas pedal positions, determining the engine fuel demand Q, and the proper amount of air supply required for an adequate air/fuel mix, calculating the size of injected fuel pulses q needed at the engine speed in response to the engine fuel demand Q , programming the controller to choose one of the three pressure states $P_{H2}$, $P_{H1}$, or $P_L$ so that varying the pulse width at the chosen pressure level to inject fuel pulses q covers a full operating range of the vehicle at the driving conditions, and choosing the pulse width at the detected pressure level to inject fuel pulse q to the engine.

15. The method of claim 14 wherein there are created three stable fuel pressure levels $P_{H2}>P_{H1}>P_L$ under a pre-determined substantially constant fuel pump speed, and choosing a fuel pressure level comprising the steps of:

(a) choosing $P_{H1}$ for regular highway driving and engine start-up wherein one fuel by-pass line (path) is normally open and the other fuel by-pass line is normally closed, varying pulse width at the injectors producing the injected fuel pulses q covering the entire operating range at $P_{H1}$ for highway driving, where the maximum amount of fuel injected at $P_{H1}$ sets the maximum power rated for the engine;

(b) choosing $P_L$ which is higher than the minimum pressure needed to produce fine fuel mists, by opening both fuel by-pass paths for city driving when engine is warm, varying the pulse width to inject fuel pulses q under $P_L$ to cover the entire operating range of city driving; where the largest amount of fuel injection under $P_L$ sets the maximum power under $P_L$, and (c) creating an enhanced power drive mode by closing both fuel by-pass lines to create the highest pressure at $P_{H2}$ thus injecting largest fuel pulses for a finite duration in response to urgent need for power and torque during passing and speeding, and engine not overheated.

16. A method of creating dual pressure levels in an engine's fuel injection system including a fuel pump set to run at a predetermined substantially constant speed which is independent of the engine speed for sending pressurized fuel from a fuel tank through a main fuel line to a fuel plenum in fluid communication with at least one fuel injector, at least one fuel by-pass line forming a fuel recirculation loop for returning pressurized fuel from a location upstream of the plenum to either the fuel reservoir or the inlet of the fuel pump to stabilize the fuel pressure level in the main fuel line, the at least one fuel by-pass line including a flow constraint of a first fixed flow constraint value, the at least one fuel by-pass line being selectively opened/closed by a binary valve element which is either opened to establish a fuel pressure level of $P_L$ to the plenum or closed to increase the fuel pressure level to $P_H$, wherein the pulse width of injected fuel pulses can be varied under $P_L$ in accordance with one driving condition and varied under $P_H$ in accordance with another driving condition to widen the fuel injection dynamic range, the method comprising the step of changing the flow constraint value to a second fixed flow constraint value including replacing a different flow constraint element, such that the fuel pressure assumes a different level $P_{L1}$ when the valve element is in its opened position, while maintaining the higher pressure level $P_H$ unchanged when the valve element is in its closed position.

17. A method of creating dual pressure levels in an engine's fuel injection system including a fuel pump set to run at a predetermined substantially constant speed which is independent of the engine speed for sending pressurized fuel from a fuel tank through a main fuel line to a fuel plenum in fluid communication with at least one fuel injector, at least one fuel by-pass line forming a fuel recirculation loop for returning pressurized fuel from a location upstream of the plenum to either the fuel reservoir or the inlet of the fuel pump to stabilize the fuel pressure level in the main fuel line, the fuel by-pass line including a flow constraint of fixed flow constraint value, the at least one fuel by-pass line being selectively opened/closed by a binary valve element which is either opened to establish in the main fuel line a fuel pressure level of $P_L$ or closed to increase the fuel pressure level to $P_H$, wherein the pulse width of injected fuel pulses can be varied under $P_L$ in accordance with one driving condition and varied under $P_H$ in accordance with another driving condition, the method comprising the step of re-setting the fuel pump speed to a different predetermined substantially constant speed which is independent of the engine speed such that the fuel pressure in the main fuel line instantly assumes different levels $P_{L1}$ and $P_{H1}$ when the valve element in the at least one fuel by-pass line is opened or closed, respectively.

18. A method for regulating the pressure in a constant speed multi-pressure fuel injection system for an engine, the method comprising the steps of:

A. setting a fuel pump to run at a predetermined substantially constant speed which is independent of the engine speed for sending pressurized fuel from a fuel tank through a main fuel line to a fuel plenum in fluid communication with at least one fuel injector; at least one fuel by-pass line forming a fuel recirculation loop for returning pressurized fuel from a location upstream of the plenum to either the fuel reservoir or the inlet of the fuel pump to stabilize the fuel pressure level in the main fuel line, the at least one fuel by-pass line including a binary valve element and a flow constraint of fixed flow constraint value, B. receiving a signal from a gas pedal sensor indicating a desired engine power;

C. determining if the signal meets a predetermined engine power request threshold;

D. in response to the signal meeting the pre-determined threshold in step C, closing a fuel bypass line from fuel line to fuel tank to raise the fuel pressure in the fuel injection system; and E. maintaining the closed fuel bypass line in a closed state while the predetermined engine power request threshold is met.

19. The method of claim 18, wherein step C comprises checking the signal a predetermined plurality of consecutive times to verify that the signal meets the pre-determined engine power request threshold.

20. The method of claim 18, wherein if the signal meets the pre-determined threshold in step C, determining if the temperature of the engine is below a pre-determined engine temperature threshold and closing the fuel bypass path in step D only if the engine temperature is below the pre-determined engine temperature threshold, wherein step E comprises maintaining the fuel bypass value in a closed state while the predetermined engine power request threshold is met and the engine temperature is below the pre-determined engine temperature threshold.

21. The method of claim 18, wherein if the signal meets the pre-determined threshold in step C, determining if the fuel by-pass path has been closed for less than a pre-determined time period and closing the fuel bypass path in step D only if the fuel by-pass path has been closed for less than the pre-determined time period, wherein step E comprises maintaining the fuel bypass valve in a closed state while the predetermined engine power request threshold is met and the fuel by-pass path has been closed less than the pre-determined time period.

22. A method for regulating the pressure in a constant speed multi-pressure fuel injection system for an engine of a vehicle, the method comprising the steps of:

A. operating a fuel pump at a substantially constant speed which is independent of engine speed for sending pressurized fuel from a fuel tank through a fuel line to fuel rail and then to a fuel injector, B. providing a fuel by-pass line forming a fuel recirculation loop for returning pressurized fuel from a location upstream of the plenum to either the fuel reservoir or the inlet of the fuel pump to stabilize the fuel pressure level in the main fuel line, the fuel by-pass line including a flow constraint of fixed flow constraint value, the at least one fuel by-pass line being selectively opened/closed by a binary valve element which is either opened or closed, and C. providing a manual override accessible to a driver of the vehicle actuable to open the valve element to instantly lower the fuel pressure.

* * * * *